US005687436A

United States Patent [19]

Denton

[11] Patent Number: 5,687,436

[45] Date of Patent: Nov. 18, 1997

[54] WHEELCHAIR SEATING CUSHION HAVING ADJUSTABLE TOP CONTOUR SHAPE

[75] Inventor: Grant C. Denton, Boulder, Colo.

[73] Assignee: Jay Medical Ltd., Boulder, Colo.

[21] Appl. No.: 694,536

[22] Filed: Aug. 9, 1996

[51] Int. Cl.[6] ..... A47C 27/02

[52] U.S. Cl. ..... 5/653; 5/654; 5/655.9; 5/657; 297/452.25

[58] Field of Search ..... 5/653, 654, 655.5, 5/655.9, 657; 297/452.25, 452.27, 452.28, 284.3, 284.5

[56] References Cited

U.S. PATENT DOCUMENTS

| | | | |
|---|---|---|---|
| 4,726,624 | 2/1988 | Jay . | |
| 4,819,286 | 4/1989 | Beauchamp | 5/653 |
| 4,951,334 | 8/1990 | Maier . | |
| 4,960,304 | 10/1990 | Frantz | 297/452.28 X |
| 5,018,790 | 5/1991 | Jay . | |
| 5,088,747 | 2/1992 | Morrison et al. | 5/654 X |
| 5,137,333 | 8/1992 | Chee . | |
| 5,189,747 | 3/1993 | Mundy et al. | 297/452.27 X |
| 5,333,921 | 8/1994 | Dinsmoor . | |
| 5,343,876 | 9/1994 | Rogers | 5/654 X |
| 5,378,045 | 1/1995 | Siekman . | |
| 5,513,899 | 5/1996 | Michaels et al. . | |

*Primary Examiner*—Michael F. Trettel
*Attorney, Agent, or Firm*—Flehr Hohbach Test Albritton & Herbert

[57] ABSTRACT

Seating cushion assembly (10) for use with a wheelchair having a seat base (20). A flexible foam cushion (30) is mounted on base (20) with at least one insert member (40) removably positioned at a support location (33) between the foam cushion (30) and the base (20) to upwardly or outwardly raise a top surface (5) of the foam cushion (30) at the support location (33). The resulting lateral support contour (35) in the top surface (5) of the cushion assembly provides user stability and pressure distribution while seated on the seating assembly (10) and yet the user can selectively eliminate or remove the contours (35) by removing the contour-forming inserts (40). The foam cushion (30) further has sufficient thickness and resiliency to permit the user to temporarily sit directly over the contour-forming insert member (40) during use of the cushion assembly (10), which enables safe use of the entire area of the wheelchair cushion assembly (10).

12 Claims, 3 Drawing Sheets

WHEELCHAIR SEATING CUSHION HAVING ADJUSTABLE TOP CONTOUR SHAPE

TECHNICAL FIELD

The present invention relates to seating cushions having top surfaces which can be, or are, shaped or contoured, and more particularly, relates to seating cushions for wheelchairs having removable, contour-forming wedges or cushion shaping members.

BACKGROUND OF THE INVENTION

1. Wheelchair Seating Systems Having Contoured Top Surfaces

Seating systems with shaped support surfaces are well known. This is particularly true in the design of seating systems for wheelchairs since wheelchair cushions often are shaped or contoured to assist in better positioning the user and in restraining unwanted motion, particularly lateral motion, in the legs and torso of the user. Accordingly, a top surface contour of wheelchair seating cushions is often designed with upwardly protruding regions or contours at the sides and center of the cushion, and particularly at the front end of the cushion, so as to properly position the legs and prevent lateral shifting or sliding of the user on the cushion. Such contours prevent splaying or separation of the legs (abduction), positioning of the legs too close together (adduction), and positioning of both legs to one side (wind sweeping). Providing such a contoured surface positions the user's legs in a generally parallel and forwardly facing orientation. This type of contouring also tends to better center the user's hips and body on the cushion, thus providing improved weight distribution, improved posture and lateral stability.

The use of contouring in the top surface of a wheelchair cushion assembly also has undesirable side effects. Contouring may tend to prevent the user from sitting on areas of the seat cushion which are upwardly raised. Greater freedom of movement, such as movement over the entire surface of the seating cushion is typically desired by those wheelchair users who are very active and who find deep contouring in the top surface restraining. Contouring of the seat assembly may not even be required or desirable for some users. But for many wheelchair cushion users, the ability to move about freely, or at least to rest safely upon all areas of the seating cushion for short periods, is desirable for those occasions when users are transferring into and out of the wheelchair. Furthermore, the same individual user may desire additional contouring in the top surface at times when lateral stability is advantageous, but not at other times. This is particularly true for users who use the same seating cushion for sports activities and for more passive general use.

Accordingly, one major limitation with designing the contours found on the top surface of a wheelchair cushion is that in certain instances they are desired and in other instances they may be quite undesirable. Consequently, wheelchair seat assemblies with permanently contoured top surfaces are not adaptable to these contradictory demands. A much better solution is to provide a wheelchair seating cushion having a top surface, the contour of which is easily adjustable. For example, should the user want or require additional lateral support tending to center and hold his or her legs in a roughly parallel forward facing orientation, the top surface of the seating cushion would be adaptable so as to provide recesses under the legs and protruding or raised areas at the sides and possibly between the legs. On the other hand, when the user desires more freedom of lateral movement in their legs and a greater ability to move themselves freely around upon the entire top surface of the wheelchair seating cushion, the user should be able to quickly and easily reduce or eliminate the contouring. Consequently, in one aspect of the present invention what is desired is a seating cushion for a wheelchair having the ability to quickly and easily change the top contour or shape of the cushion assembly.

Another major problem in designing contours into the top surface of a wheelchair seating cushion is that the user is not able to safely sit upon the regions where the cushion surface is upwardly raised or contoured. This is particularly true at the front of wheelchair seating assemblies which tend to protrude upwardly at their side edges and middle. More contouring is typically found toward the front of the seating assembly than towards the rear. As the front of cushion assemblies is the area in which the user tends to desire to move about to a greater degree, this area must provide a safe seating region for a user, that is, an area which can be temporarily sat upon without the risk of causing skin damage. Existing upwardly contoured surfaces usually are too hard to allow a user to safely sit upon these regions, even for short periods, such as when the user is transferring into and out of the wheelchair. What would be desired instead is a seating cushion, which although it possesses upwardly raised contours, has contours which are not so hard that a user is unable to sit safely upon them for short periods of time. Since wheelchair users often have little or no sensitivity below the level of their injury, safety is a primary problem. Bottoming out on relatively hard cushion shaping wedges can almost immediately raise pressures on the user's ischials or bony prominences to undesirable and unsafe levels at which skin damage can start to occur. Moreover, sitting over relatively hard shaping wedges reduces the user's stability on the seat cushion because there is no immersion of the user's body in the cushion over the hard raised contours.

Furthermore, it is important that when a seating cushion has its top surface contour reduced or eliminated, the resulting support for the user should remain uniform, soft and even across the entire surface area of the seating cushion. In particular, the creation of soft spots, gaps, internal holes and pockets in the cushion should be avoided.

2. The Limitations of Various Specific Prior Art Systems

Various existing wheelchair cushion assemblies disclose shaping trays and/or wedges positioned below fluid-filled pouches which provide support for a user seated thereon. The limitations of this type of devices soon become apparent.

U.S. Pat. Nos. 4,726,624 and 5,018,790 to Jay and U.S. Pat. No. 5,333,921 to Dinsmoor et al., disclose customized seating assemblies with removable contour-forming supports which are positioned between a shaped tray and a pouch or envelope containing a flowable fluid material. These assemblies allow contouring of the fluid-filled pouch for greater lateral stability. When the user sits between upwardly protruding wedges, fluid in the pouch migrates to more evenly support the user's weight and prevent pressure sores. Migration of fluids in the pouch, however, can be a problem when the user sits directly over a contour-forming wedge. The fluid pouch will tend to bottom out under the user if the user sits directly over any of the contour-forming wedges or supports. As such, the user is not able to safely and effectively make use of the entire seating area of the seat cushion, and particularly the critical front area. U.S. Pat. No. 5,378,045 to Siekman et al. and U.S. Pat. No. 5,513,899 to Michaels also disclose seat cushions using a shaped tray and fluid-filled envelope. These assemblies, however, merely use side wedges mounted on the underside of the rigid tray which are selectively removable to accommodate the presence of a cross-brace mechanism, as is commonly used in drop-seat wheelchairs. These side wedges are not designed to shape or contour the top surface of the cushion, nor even to provide shaping to the fluid-filled pouch.

Various existing seating cushions disclose shaping members or wedges positioned below foam cushions which provide additional lateral support for a user seated thereon. Their limitations also quickly become apparent.

In U.S. Pat. No. 4,951,334 to Maier, a pressure relief cushion containing various layers of foam materials with at least two different degrees of resiliency is disclosed. The major limitation with this device is that it does not provide any contouring at all in the top surface of the cushion assembly. Instead, it depends upon resiliency variation to effect contouring under loading. This approach makes it more difficult to change user support because it requires removal of foam layers and replacement with other layers, or unacceptable holes or pockets will be present in the internal structure of the cushion.

In U.S. Pat. No. 5,137,333 to Chee, a seating cushion including a ridged base and a number of internal slanting foam wedges received in various internal pockets is disclosed. The foam wedges have a different resiliency than the body of the seat cushion. This seating cushion is not at all adaptable for use with a wheelchair. Other major limitations with this cushion are that the top contour of the seat cushion is not shaped so as to provide any lateral support to a user's legs. This top surface contour is not freely variable by a user, but rather is fixed in position. Moreover and very importantly, any attempt to remove the foam wedges to alter the support provided by the foam cushion would result in an empty pocket, thus producing a soft spot if the user were to sit directly upon this part of the cushion.

Similarly, a wheelchair seat cushion assembly sold under the trademark METALCRAFT AS 5000 by Metalcraft Industries, Inc. of Oregon, Wis., and described in a brochure entitled "Metalcraft's Modular Seating System," employs relatively firm shaping wedges under a viscoelastic foam pad. Removal of the shaping members, however, leaves gaps or voids into which the viscoelastic foam will conform.

3. Objects of the Invention

Accordingly, it is an object of the present invention to provide a contoured seating assembly for wheelchairs wherein a user can sit safely directly upon all areas of the top surface of the seating assembly. Specifically, the user would be able to sit at all locations on the contoured top surface of the seating cushion for at least short periods of time without unsafe pressure buildup.

It is another object of the present invention to provide a seating cushion assembly for wheelchairs having a selectively adjustable contour in its top surface.

It is another object of the present invention to provide a seating assembly for wheelchairs which provides lateral stability to a user and which tends to orient the users legs in a forward facing parallel orientation.

It is another object of the present invention to provide a seating cushion assembly having an adjustable contour in its top surface such that when this top surface is adjusted into a flattened or less contoured position, soft spots, pockets or holes are not formed at any locations within this seating assembly.

It is another object of the present invention to provide a lightweight wheelchair seating assembly for active users.

Other objects and features of the present invention are set forth in, or will become apparent from, the following Best Mode of Carrying Out the Invention and accompanying the drawings.

DISCLOSURE OF INVENTION

The present invention discloses a seating cushion assembly for use in a wheelchair, comprising: (a) a flexible foam pad or cushion formed to be supported on a wheelchair seat base, such as sling seat or a rigid seat pan; and (b) at least one relatively rigid insert member removably positioned at a support location between the foam pad and the seat base and formed to raise or elevate a top surface of the foam pad at said support location to provide a support contour in the top surface. The foam pad further has sufficient thickness and resiliency to permit the user to temporarily safely sit directly over the insert member during use of the seating assembly. The cushion assembly most preferably further includes a seat cover over the cushion or foam pad which has pockets therein to receive the cushion or pad-shaping wedges.

BEST MODE OF CARRYING OUT THE INVENTION

Contouring of the top surface of wheelchair seating cushions is currently used to provide improved posture, weight distribution and lateral support to a user such that the user remains properly centered upon the seating cushion with the user's legs are not abducted, adducted or wind swept. Typically, such contouring is used to raise the side edges, especially at the front of the seating assembly, to thereby provide additional support to the outer sides of the user's legs. Often a raised abductor region is also provided between the user's legs at the front of the cushion assembly.

The problem with cushion contouring, particularly in the front of a wheelchair seat, is that often it is desired for wheelchair users to sit, at least temporarily, on the entire front area of the seat, including the raised or contoured portions of the seat cushion. Furthermore, the same user may desire a deeper, more contoured seating cushion at certain times for improved lateral stability, but prefer a smoother, flatter contour for athletic uses. Present wheelchair seating cushion designs are not readily able to provide such freely adjustable top surface contours in their cushion assemblies. The present invention overcomes this limitation by providing a seating assembly for a wheelchair which has more usable seating area, allowing the user to sit safely on the entire cushion, and it has a top surface with a contour which can be easily adjusted.

Figure 1:
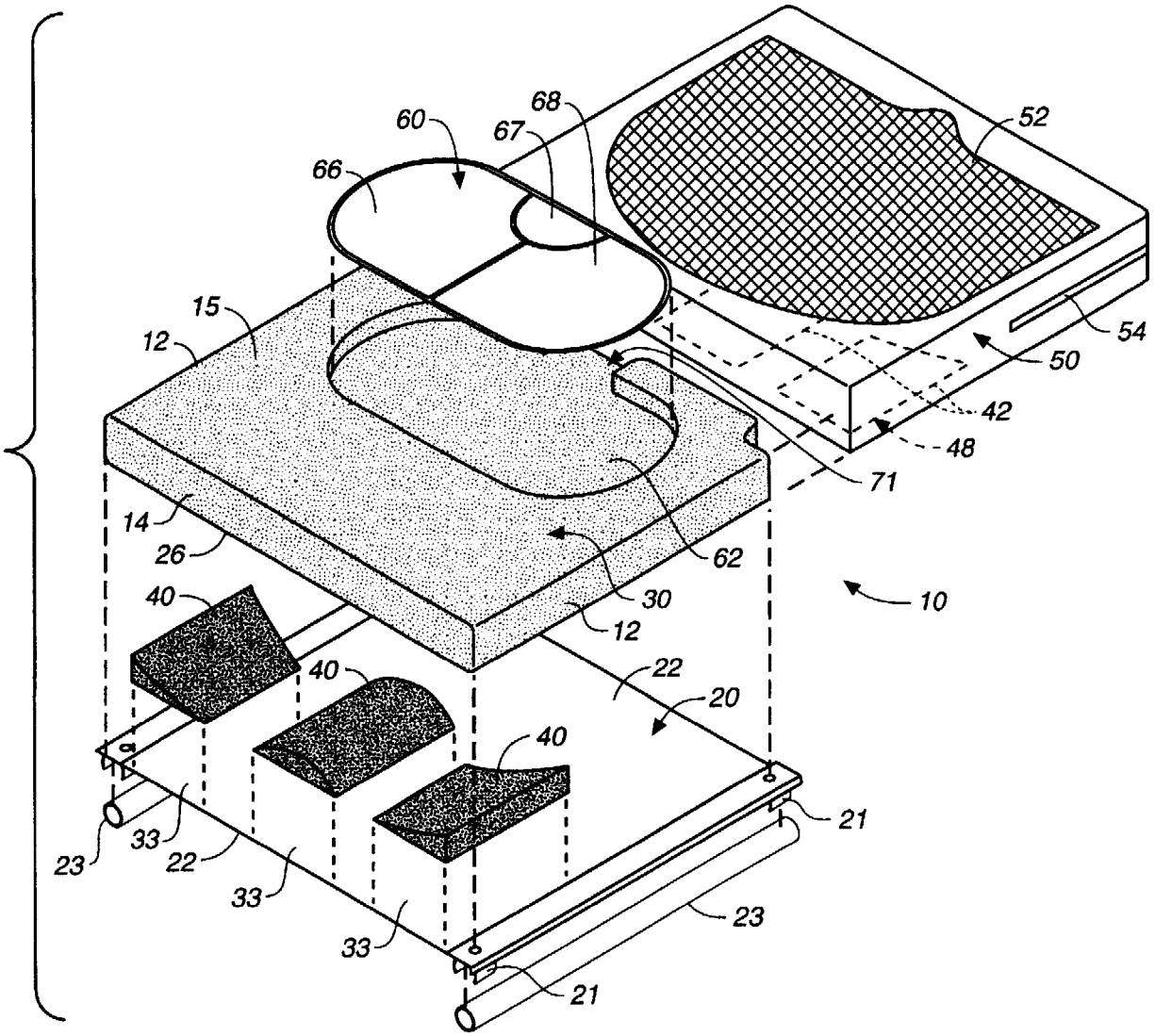
FIG. 1 is an exploded, perspective, schematic representation of a seating cushion assembly for use with a wheelchair, constructed in accordance with the present invention.

As is best seen in FIG. 1, a seating cushion assembly, generally designated 10, for use in a wheelchair, is provided. Seating cushion assembly 10 is composed of a soft and flexible foam cushion or pad, generally designated 30, and a plurality of removable, relatively rigid, insert members 40. Most preferably, cushion assembly 10 also includes a fabric cover 50, which is mounted over foam cushion 30 and includes pockets 42 in which cushion-shaping insert members 40 are mounted. Still further, assembly 10 can advantageously optionally include fluid-filled, pressure-compensating envelope 60.

Figure 3:
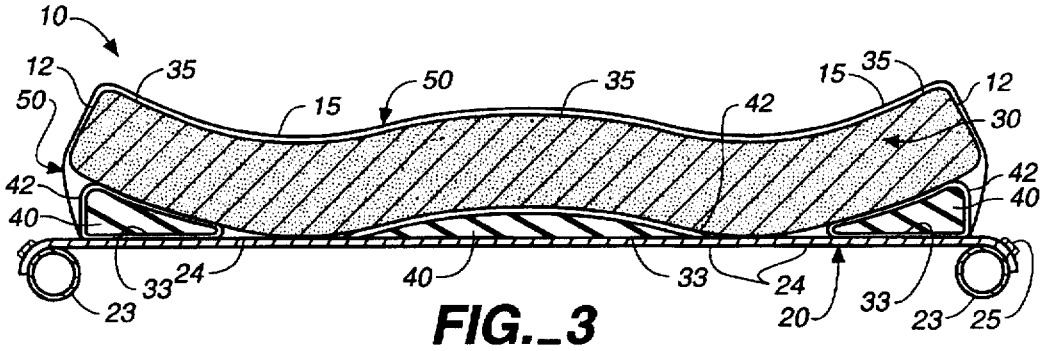
FIG. 3 is a front elevational view, in cross section, of the seating cushion assembly of FIGS. 1 and 2 taken substantially along the plane of line 3—3 in FIG. 2.
Figure 3A:
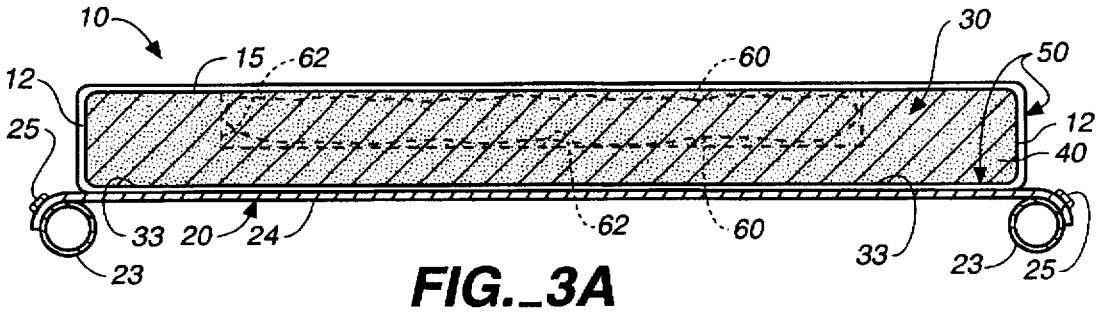
FIG. 3A is a front elevation view, in cross section, corresponding to FIG. 3 with the cushion-contouring wedges removed.

Foam cushion or pad 30 is formed for mounting on a wheelchair seat base, generally designated 20, which can take the form of a relatively rigid seat pan 22 (FIG. 1) or a sling-type seat 24 (FIGS. 3 and 3A). Thus, cushion 30 has a downwardly facing surface 26, which preferably substantially mates with wheelchair base 20. As illustrated, surface 26 is planar, but it will be understood that if pan 22 were contoured, surface 26 could include substantially mating downwardly facing contours.

When base 20 takes the form of a seat pan 22, the pan may be constructed of a relatively rigid material, such as wood, plastic or aluminum, which has high strength to weight properties for support of cushion 30 and the user thereon. Pan 22 may be planar or contoured and may be adapted with mounting clips 21 that are preferably connected to the side rails 23 of a wheelchair (not shown), in place of, and after removal of, the standard sling seat and mounting hardware provided by most wheelchair manufacturers. The seat base mounting structure is not critical to the present invention, and seat pan 22 can be a drop seat or at the same level as the wheelchair frame members, as shown in the drawing. It will be understood that the present seat assembly also can be provided as original equipment on the wheelchair and pan 22 or sling 24 can be mounted permanently, not removably, directly to rails 23 by fasteners 25 (FIGS. 3 and 3A).

Figure 4:
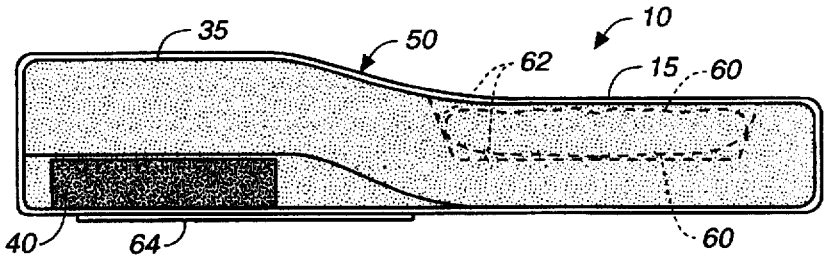
FIG. 4 is a side elevational view of the seating cushion assembly of FIG. 1.

As is seen in FIGS. 1 and 3, foam cushion 30 is adapted to substantially cover and be mounted upon the top surface of seat base 20, in order to provide cushion support to a user seated thereon. Contour-forming insert members 40 are removably positioned at support locations 33 between seat base 20 and soft foam cushion 30 such that insert members 40 shape the soft flexible foam cushion by pushing it slightly upwards at support locations 33 thereby providing outwardly or upwardly raised contours 35 (FIGS. 3 and 4) in top surface 15 of foam cushion 30. A specific feature of top surface contour 35 is the raising of foam cushion 30 at support locations 33, which preferably are located proximate to sides 12 and front 14 of cushion assembly 10 (adductors) and optionally at the middle and front of the cushion (an abductor). Thus, contours 35 provide additional lateral stability to a user such that the user is stabilized against lateral shifting on the cushion, for example, as the wheelchair makes sharp turns. The user's legs also are positioned in a manner preventing abduction, adduction and wind sweeping. In addition, by providing additional support to the sides of a user's legs, contour 35 of top surface 15 tends to center the user's hips and body upon surface 15 of the cushion assembly, thus providing improved weight distribution.

In order to secure contour-forming insert members at fixed desirable locations 33 relative to seat base 20, a securement structure is preferably provided. The securement structure can take the form of hook and loop fastener strips attached to insert members 40 and one of seat base 20 and cover 50. In the most preferred embodiment, however, the securement structure is provided by pockets or pouches 42 attached to cover 50 which surrounds foam cushion 30.

Insert members 40, therefore, are preferably slidably received in pockets or pouches 42 inside fabric cover 50 at a location between the cover and foam cushion 30. The pockets enable inserts 40 to be easily inserted or removed at the convenience of the user. Pouches or pockets 42 are preferably sewn at 46, or otherwise fastened, into the inside of cushion cover 50 and have openings 48 therein dimensioned to slidably receive contouring wedges 40. Most preferably, pockets 42 open in a direction transverse to the direction of loading of wedge 40 by the user. Thus, openings 48 are oriented in a fore/aft direction, but pockets 42 are closed in a side-to-side direction since the user's weight on wedges 40 will tend to urge the wedges laterally. Moreover, pockets 42 most preferably open in a fore direction and are closed in an aft direction so that the wedges are trapped between the closed ends of the pockets and the inside front end of the cover.

Placement of pockets inside cover 50 tends to protect the insert members from separating from cushion assembly 10 because they are surrounded by the cover. Thus, the cushion assembly can be lifted from wheelchair seat base 20 without loss, or the need for repositioning of the wedges. Alternatively, however, and still in keeping with the scope of the present invention, pockets 42 could be secured to the outside of cover 50 or to seat base 20, for example, by hook and loop fasteners (VELCRO fastener assemblies).

Accordingly, the present invention provides a simple solution to the problem of providing a wheelchair seating system with easily adjustable contours 35 in top surface 15. By alternatingly inserting or removing insert members 40 into pouches 42, top surface contours 35 of the seating assembly are easily created or eliminated. The thickness, density and rigidity of insert members 40 directly influences the amount of contour induced in foam cushion 30. Therefore, top contours 35 can easily be altered by installing insert members 40 having different thicknesses, densities or rigidity into pockets 42. Preferably, insert members 40 are wedge-shaped or sloping along their sides so as to gradually flair or form sloping side portions of contour 35.

Because insert members 40 are positioned below a relatively soft and flexible foam cushion 30, specifically at support locations 33, most users are able to continue to sit safely directly upon all areas of the foam cushion, even at locations which are directly positioned over contouring members 40. Foam pad 30 is preferably provided by an open cell polyurethane foam which has a sufficient thickness and resiliency to safely support a user temporarily sitting thereupon with an insert 40 present directly below the user. The sensitivity of each user to the formation of pressure sores varies from individual to individual. Moreover, one can vary the softness, density and thickness of cushion 30 substantially within the scope of the present invention and still provide considerable protection of the user against pressure sores from sitting over insert members 40. Still further, the rigidity of the inserts and the duration of sitting over them will affect safety.

One set of cushion parameters which has been found to be particularly effective in providing a safe seating surface for short periods for a wide range of users, even when sitting directly over wedges 40, are as follows: open-cell polyurethane foam cushion having a thickness dimension of about 2¼ inches and an Indentation Load Force Deflection (ILD) of about 30 pounds at 25% deflection of a 50 square inch area, with open cell polyurethane wedges having an ILD of about 40 pounds at 25% deflection. It is believed that significant safety would be achieved with foam cushions down to a thickness of about one inch, and possibly less, or that ILD ratings at 25% deflection as low as about 15 to 20 pounds could be used, particularly with thicker cushions. A cushion 2¼ inches thick, however, is regarded in the industry as a relatively "low profile" cushion which makes user transfers in and out of the wheelchair easier. Tradeoffs, however, are possible in the softness and thickness of the present foam cushion, as well as wedge members 40, which would still provide a cushion assembly of sufficient softness and thickness to allow at least temporary, safe seating directly over wedges or contour-forming members 40. Wedges 40 are preferably provided by foamed plastic members, but solid or hollow non-foamed plastics, as well as wood, fiberglass and even lightweight metal members could be employed.

For very active users, such as those engaging in sporting events, the present cushion assembly is very advantageous. It allows the user to sit at front edge 14 for the cushion while engaging in various activities. The presence of a foam layer over wedges 40 also helps stabilize the user on the cushion, even when sitting over the wedges, by providing immersion member 30 by which the user can be laterally supported to some degree. For non-sporting applications, the present cushion facilitates user transfers into and out of the wheelchair and simple activities which are aided by sitting at the front of the cushion, for example washing the user's hands. This important safety or cushioning feature provides advantages over prior art designs.

Accordingly, having easily adjustable top contours 35, the present invention achieves a flexible structure providing a contoured seat which provides adjustable lateral support and a soft foam cushion overlay allowing the user to be free to comfortably move about upon the entire top surface 15 of the seat assembly. The foam cushion 30 over shaping wedges 40 also affords a degree of immersion into cushion 30 even over inserts 40 which provide enhanced lateral stability to the user when seated on the front of the present cushion assembly.

Because insert members 40 are optionally removable, foam cushion 30 returns to a lowered position, as seen in FIG. 3A, at previous locations 33 for the insert members 40. Moreover, in the present cushion assembly, no internal holes, gaps or spaces are formed upon the removal of insert members 40. Rather, upon removal of insert members 40, bottom surface 26 of cushion 30 is placed in contact with seat base 20, with cushion 30 resting directly upon base 20 such that gaps do not form between pan 20 and cushion 30.

Figure 2:
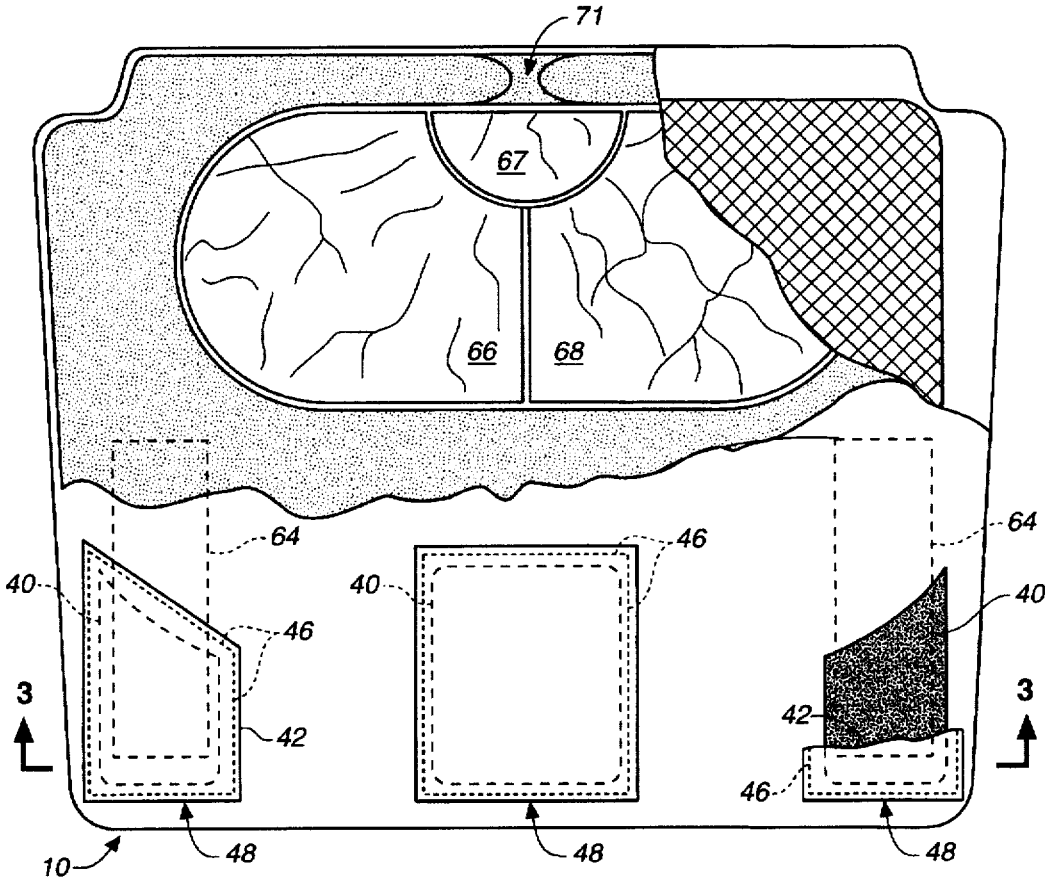
FIG. 2 is a top plan view of the assembled seating cushion assembly of FIG. 1 with portions broken away to illustrate the assembly components.

As is best seen in FIGS. 1 and 2, the cushion assembly of the present invention is adapted to be used with an optional fluid-filled pouch 60 received into a recess 62 in foam cushion 30 thereby providing support to the user's ischial tuberosities and coccyx. Pouch 60 is shown having three independent and sealed compartments 66, 67 and 68 which each contain a flowable material or fluid of the type well known in the art. Moreover, cushion assembly 10 can advantageously be secured in place on seat base 20 by hook and look fastener strips 64 (FIGS. 2 and 4) which are secured to the outside of the bottom panel of cover 50 and coupled to strips (not shown) mounted on seat base 20.

Foam cushion 30 advantageously has a surface which is treated with a synthetic rubber coating which, ensures that the surface of the foam cushion is water resistant. This coating also acts as a protein barrier. This is especially important in view of the fact that when an active user is seated thereupon, this user may typically be perspiring, especially when performing sports activities. Cushion 30 also can be relieved or open at 71 at the center of pouch recess 62 for coccyx relief.

Lastly, as seen in FIGS. 1 and 2, cover 50 preferably comprises an envelope which wraps around the combination of foam pad 30 and insert members 40. A large area 52 of breathable and stretchable material, such as Spandex, is provided on the top surface of envelope 50. Cover 50 may be provided with a zipper 54 (FIG. 1) which extends across the back of the cushion and partially around the sides to permit disassembly of the cover from the cushion and/or insertion of wedges 40 into pockets 42.

What is claimed is:

1. A seating cushion assembly for use in a wheelchair, comprising:

a) a flexible foam cushion formed for mounting on a seat base of a wheelchair to substantially cover said base; and b) at least one wedge-shaped insert member oriented to taper in traverse direction across said cushion assembly and removably positioned at a support location between said foam cushion and said seat base and formed to raise a top surface of said foam cushion at said support location to provide a lateral support contour in said top surface for a user seated on said cushion assembly, said foam cushion further having sufficient thickness and resiliency to permit the user to temporarily sit safely directly over said insert member during use of said cushion assembly.

2. The seating cushion assembly of claim 1 wherein, said cushion assembly has a front and a back and two sides, and said support location is positioned in a region proximal to both said front and one of said sides of said cushion assembly.

3. The seating cushion assembly of claim 1 wherein, said insert member is provided in a shape suitable for use as an abductor.

4. The seating cushion assembly of claim 1 wherein, said insert member is provided in a shape suitable for use as an adductor.

5. The seating cushion assembly of claim 1 wherein, said support contour in said top surface is positioned to provide lateral support to the legs of a user such that the user's legs are positioned in a forward-facing parallel orientation.

6. The seating cushion assembly of claim 1, and a seat pan having a substantially planar top surface and a mounting assembly for securement of said seat pan in a generally horizontal orientation to a wheelchair; and said flexible foam cushion rests directly upon said top surface of seat pan.

7. The seating cushion assembly of claim 1 wherein, said flexible foam cushion is made from an open-cell polyurethane foam.

8. The seating cushion assembly as defined in claim 1 and a cover substantially surrounding said flexible foam cushion; and a securement structure coupling said insert member to one of said cover and said seat base in a relatively fixed location.

9. A seating cushion assembly for use in a wheelchair, comprising:

a) a flexible foam cushion formed for mounting on a seat base of a wheelchair to substantially cover said base;

b) at least one insert member removably positioned at a support location between said foam cushion and said seat base and formed to raise a top surface of said foam cushion at said support location to provide a support contour in said top surface for a user seated on said cushion assembly, said foam cushion further having sufficient thickness and resiliency to permit the user to temporarily sit safely directly over said insert member during use of said cushion assembly; and c) a fabric cover substantially surrounding said foam cushion and formed with at least one pocket therein having an opening therein dimensioned to and receiving said insert member therein.

10. The seating cushion assembly of claim 9 wherein, said cover includes a plurality of pockets each formed to and receiving an insert member therein and each positioned to provide contours in said foam cushion at predetermined support locations.

11. The seating cushion assembly of claim 9 wherein, said pocket is provided on an inside of said cover.

12. The seating cushion assembly as defined in claim 9 wherein, said pocket opens on a side thereof transverse to the direction of loading of said insert member by said user's weight when said user is seated on said cushion.

* * * * *